US009387575B2

(12) United States Patent
Wei

(10) Patent No.: US 9,387,575 B2
(45) Date of Patent: Jul. 12, 2016

(54) TOY GUN WITH BUILT-IN HAND-TOOL ASSEMBLY

(71) Applicant: Ho-Sheng Wei, New Taipei (TW)

(72) Inventor: Ho-Sheng Wei, New Taipei (TW)

( * ) Notice: Subject to any disclaimer, the term of this patent is extended or adjusted under 35 U.S.C. 154(b) by 164 days.

(21) Appl. No.: 14/278,961

(22) Filed: May 15, 2014

(65) Prior Publication Data

US 2015/0330739 A1 Nov. 19, 2015

(51) Int. Cl.

| | |
|---|---|
| ***F41B 11/70*** | (2013.01) |
| ***B25B 15/00*** | (2006.01) |
| ***F41B 11/89*** | (2013.01) |
| ***F41B 11/62*** | (2013.01) |

(52) U.S. Cl.

CPC ..... *B25B 15/00* (2013.01); *F41B 11/62* (2013.01); *F41B 11/70* (2013.01); *F41B 11/89* (2013.01)

(58) Field of Classification Search

CPC ..... F41B 1/62; F41B 11/00; F41B 11/70; F41B 11/55; F41B 11/56; F41C 27/00; F41C 23/16; F41A 35/00

USPC ..... 42/108, 90, 95, 107, 71.02, 72, 106; 124/71–77

See application file for complete search history.

(56) References Cited

U.S. PATENT DOCUMENTS

| | | | | |
|---|---|---|---|---|
| 6,389,729 | B2 * | 5/2002 | Rauch | 42/71.01 |
| 6,874,266 | B1 * | 4/2005 | Kong | F41C 23/22 42/7 |
| 7,637,049 | B1 * | 12/2009 | Samson | F41A 35/00 42/107 |
| 7,900,622 | B2 * | 3/2011 | Douglas | F41B 11/57 124/32 |
| 8,479,404 | B1 * | 7/2013 | Samson | F41A 35/00 33/506 |
| 2001/0011433 | A1 * | 8/2001 | Rauch | F41C 23/10 42/71.01 |
| 2006/0201491 | A1 * | 9/2006 | Wei | F41B 11/56 124/74 |
| 2009/0025701 | A1 * | 1/2009 | Douglas | F41B 11/57 124/77 |
| 2009/0120420 | A1 * | 5/2009 | Tippmann, Jr. | F41A 35/00 124/73 |
| 2010/0224180 | A1 * | 9/2010 | Tippmann, Jr. | F41A 35/00 124/74 |
| 2011/0226227 | A1 * | 9/2011 | Douglas | F41B 11/57 124/77 |
| 2013/0205635 | A1 * | 8/2013 | Hines | F41C 23/16 42/71.02 |

* cited by examiner

*Primary Examiner* — Jonathan C Weber
(74) *Attorney, Agent, or Firm* — Chun-Ming Shih; HDLS IPR SERVICES

(57) ABSTRACT

A toy gun with a built-in hand-tool assembly includes a gun housing and a hand-tool assembly; the gun housing has a concave slot and an inner wall formed inside the concave slot; the inner wall has a stopping portion formed thereon; the hand-tool assembly is detachably attached onto the concave slot; the hand-tool assembly includes a tool housing and a hand-tool; the hand-tool is received in the tool housing and has one end exposed out of the tool hosing; the tool hosing is configured to be fitted onto the concave slot; the hand-tool is configured to be blocked and positioned by the stopping portion. Therefore, with such structure, the toy gun includes the hand-tool built therein in order to facilitate the detachment, assembly or piercing of the air bottle in the toy gun by the user such that the convenience of use of the toy gun is increased.

13 Claims, 7 Drawing Sheets

TOY GUN WITH BUILT-IN HAND-TOOL ASSEMBLY

BACKGROUND OF THE INVENTION

1. Field of the Invention

The present invention is related to a toy gun, in particular, to a toy gun with a built-in hand-tool assembly.

2. Description of Related Art

Due to the busy work schedules and working stresses, a lot of people find recreation activities as great getaways and relieves from daily stresses; also, more and more people choose to pursuit in new and exciting recreational sports; among these sports, shooting practice is one of the most popular sports, which involves the use of toy guns of such as BB gun, paint gun and air gun as crucial gear for the sport.

However, conventional toy guns, as mentioned above, are often only equipped with one hand-tool as an auxiliary tool only for such as disassembly, assembly and piercing of air bottles, and such hand-tool may be a flathead screwdriver, a Philips screwdriver, a hexagon screwdriver for toy guns; such hand-tool of flathead screwdriver, Philips screwdriver and hexagon screwdriver can be used for fastening or releasing screws or for pushing air bottles toward the air valve to pierce through the air bottles such that the pierced air bottles can provide the driving force for the shooting of the toy guns.

Nevertheless, since not every user is of the good habit of placing and storing the hand-tool for the toy gun at proper places all the time after his or her use, the occasion of losing the hand-tool due to such as misplacing of the tool or forgetting the previous location of the tool may happen, which can be quite inconvenient and troublesome to the user in addition to that he or she may even need to purchase a new hand-tool for the toy gun as the tool may be found to be lost after some time-consuming searches.

In view of the above, the inventor seeks to provide a novel solution to overcome the aforementioned drawbacks associated with the known arts along with years of experience and application of theoretical principles in the field.

SUMMARY OF THE INVENTION

An objective of the present invention is to provide a toy gun with a built-in hand-tool assembly capable of facilitating the storage of a hand-tool for the toy gun and allowing convenient disassembly, assembly or piercing of the air bottle by the user in order to increase the convenience of the use of the toy gun.

To achieve the aforementioned objective, the present invention provides a toy gun with a built-in hand-tool assembly, comprising:

a gun housing having a concave slot and an inner wall formed inside the groove; the inner wall having a stopping portion formed thereon; and a hand-tool assembly detachably attached onto the concave slot; the hand-tool assembly comprising a tool housing and a hand-tool; the hand-tool received in the tool housing and having one end exposed out of the tool hosing; the tool hosing configured to be fitted onto the concave slot correspondingly; the hand-tool configured to be blocked and positioned by the stopping portion.

The present invention also has the following merits and technical effects:

First, the toy gun further includes an air bottle and a rotational shaft; the hand tool is able to drive the rotational shaft to rotate in order to allow the rotational shaft to push against the air bottle such that the air bottle can be pushed toward the air valve and pierced thereby; therefore, the convenience of the use of the toy gun is increased.

Second, the hand-tool can be used for fastening or releasing the fastening members on the toy gun in order to facilitate the assembly and disassembly of the toy gun; therefore, the convenience of the use of the toy gun is increased.

Third, the hand-tool can be assembled onto or detached from the concave slot such that the hand-tool can be stored inside the toy gun in order to prevent accidental loss of the hand-tool in addition to that when there is a need for the hand-tool for auxiliary uses on the toy gun, the hand-tool is readily available and can be retrieved from the toy gun immediately.

Fourth, the present invention is able to achieve the assembly and detachment of the hand-tool assembly built therein with a simple configuration and cooperation of the components of the toy gun such that the toy gun of the present invention is of the merits of simplified assembly and low cost.

DETAILED DESCRIPTION OF THE INVENTION

Figure 1:
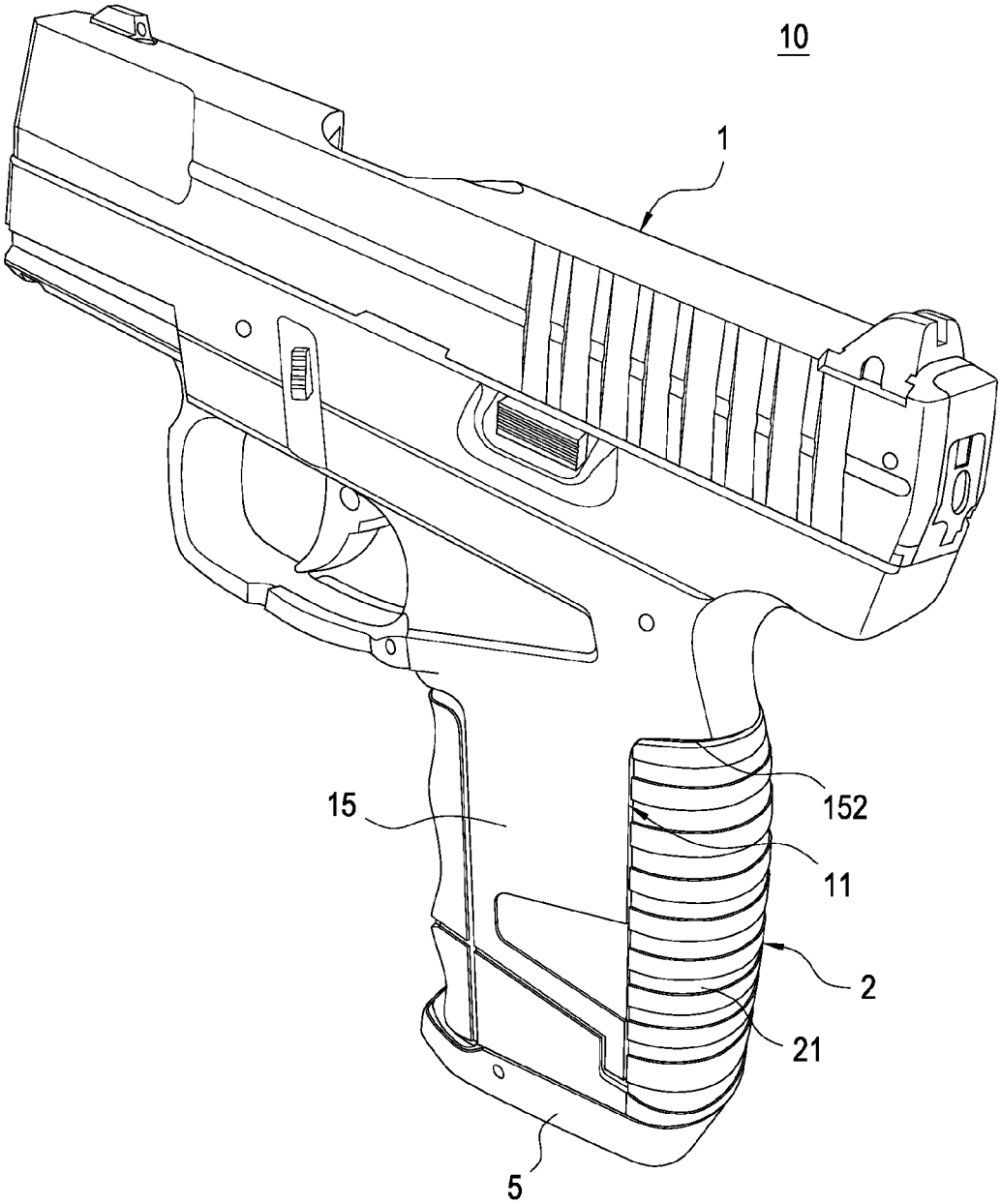
FIG. 1 is a perspective view showing an assembly of the toy gun of the present invention.

The following provides detailed description of embodiments of the present invention along with the accompanied drawings. It can, however, be understood that the accompanied drawings are provided for illustrative purposes only and shall not be treated as limitations to the present invention.

Please refer to FIG. 1 to FIG. 8. The present invention provides a toy gun with a built-in hand-tool assembly; the toy gun 10 mainly comprises a gun housing 1 and a hand-tool assembly 2.

As shown in FIG. 1 to FIG. 5, the toy gun 10 can be a BB gun, a paint gun or an air gun, and the present invention is not limited such types only. The gun housing 1 includes a concave slot 11 and an inner wall 12 formed inside the concave slot 11, and the inner wall 12 includes a stopping portion 121.

In addition, the gun housing 1 includes an air bottle slot 13 at an internal thereof and a bottom wall 14 at a bottom portion thereof. The bottom wall 14 includes an opening slot 141 connected to the air bottle slot 13, and an inner circumferential surface of the opening slot 141 includes an inner threaded portion 142 in the gun housing 1.

The following provides further details. The gun housing 1 includes a gun handle 15; the concave slot 11 is formed at the gun handle 15; the air bottle slot 13 is formed at an internal of the gun handle 15; the bottom wall 14 is formed at a bottom portion of the gun handle 15, and the gun handle 15 includes a protrusion 151 extended therefrom and arranged corresponding to the stopping portion 121.

Furthermore, the concave slot 11 is formed by an L-shaped slot 152 extended at one side of the gun handle 15 and the bottom portion thereof; the gun handle 15 includes a bulged portion 153 formed opposite from the L-shaped slot 152, and the inner wall 12 is formed at a surface of the bulged portion 153 configured corresponding to the L-shaped slot 152. In addition, the inner wall 12 includes a groove 122 and a stopping member 123 formed at a surrounding of the groove 122; the stopping portion 121 is formed by the stopping member 123.

As shown in FIG. 2 to FIG. 5, the hand-tool assembly 2 can be detachably attached onto the concave slot 11; the hand-tool assembly 2 comprises a tool housing 21, a hand-tool 22 and an elastic member 23. The hand-tool 22 is received in the tool housing 21 and includes one end exposed out of the tool hosing 21. The elastic member 23 is clamped between the hand-tool 22 and the tool housing 21. The tool hosing 21 is configured to be fitted onto the concave slot 11 correspondingly; the hand-tool 22 is configured to be blocked and positioned by the stopping portion 121.

In addition, the hand-tool 22 includes a screwdriver head 221 exposed at the tool housing 21. The elastic member 23 is a spiral spring but the present invention is not limited to such type only; in other words, the elastic member 23 can also be an elastic element of such as an elastic article or elastic sheet.

Figure 2:
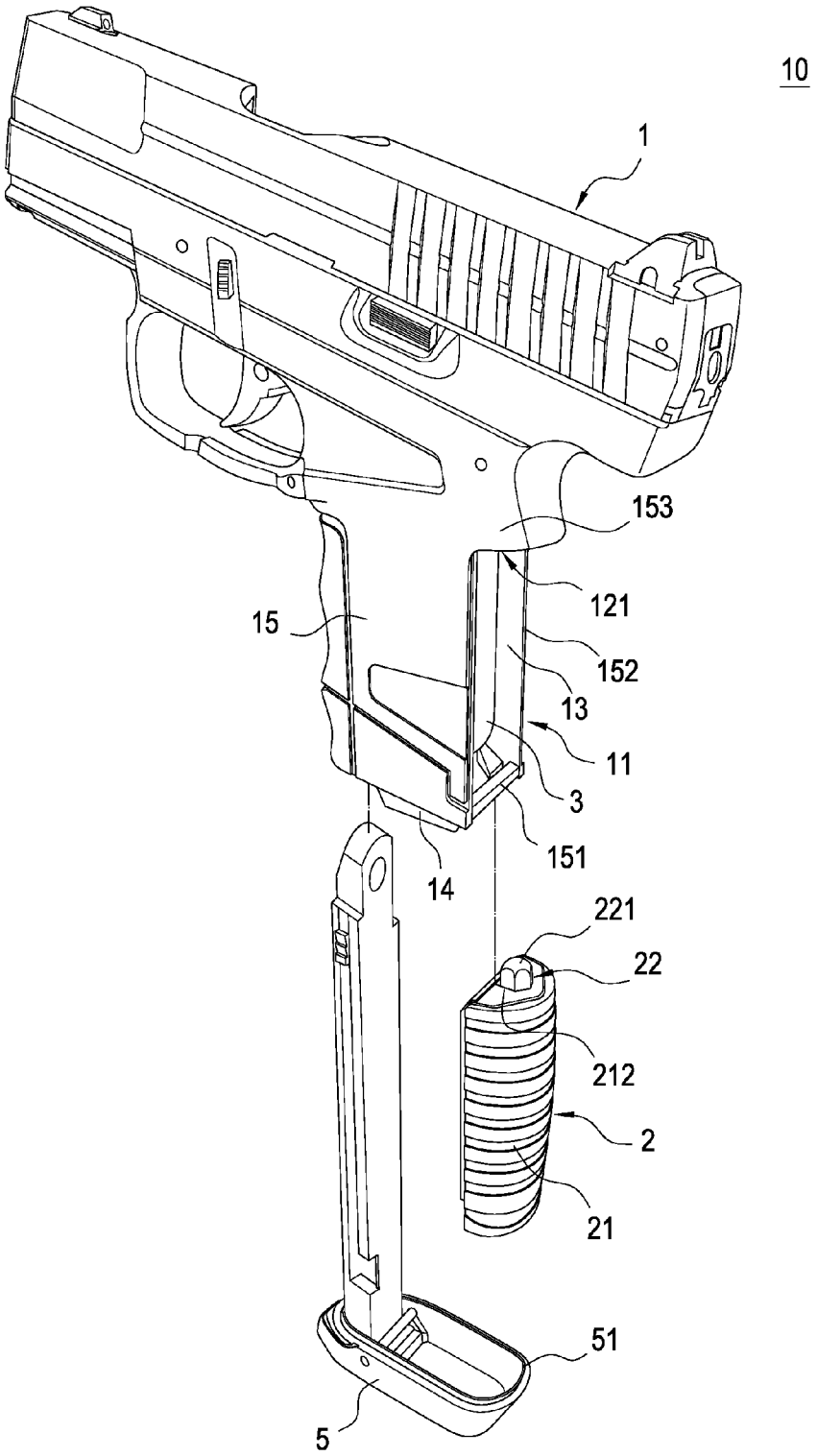
FIG. 2 is an exploded view of the toy gun of the present invention.
Figure 8:
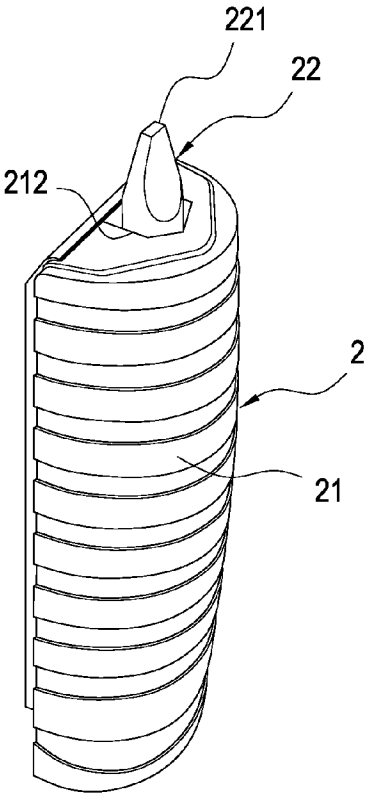
FIG. 8 is a perspective view showing an assembly of still another embodiment of the toy gun of the present invention.
Figure 7:
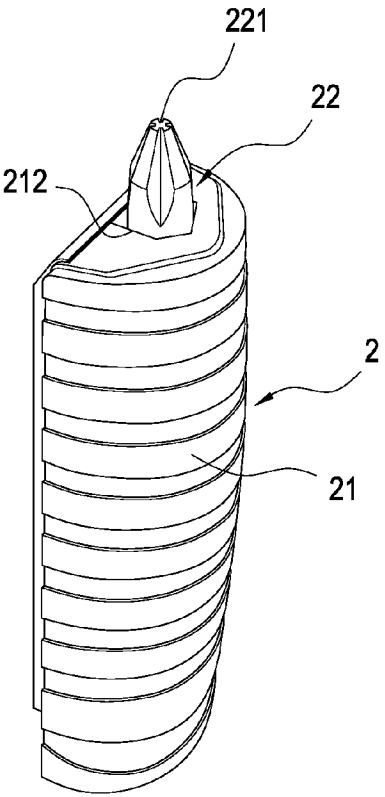
FIG. 7 is a perspective view showing an assembly of another embodiment of the toy gun of the present invention.

Furthermore, as shown in FIG. 2 and FIG. 7 to FIG. 8, the hand-tool 22 can be screwdriver of such as a flathead screwdriver, a Philips screwdriver or a hexagon screwdriver, but the present invention is not limited to such types only.

The following provides further details of the present invention. The tool housing 21 includes a chamber 211 at an internal thereof and a through-hole 212 connected to the chamber 211. The hand-tool 22 and the elastic member 23 are received inside the chamber 211; the elastic member 23 pushes against the hand-tool 22 in order to allow the screwdriver head 221 to be exposed at the through-hole 212.

In addition, the tool housing 21 includes a locking member 213 extended at one end away from the hand-tool 22, and the locking member 213 includes an insertion slot 214 formed thereon. The protrusion 151 is inserted into and positioned by the insertion slot 214, and the protrusion 151 is locked onto the locking member 213.

As shown in FIG. 2 to FIG. 5, the toy gun 10 of the present invention further comprises an air bottle 3 and a rotational shaft 4. The air bottle 3 is received inside the air bottle slot 13; the rotational shaft 4 is attached to the opening slot 141 and arranged corresponding to the air bottle 3.

Furthermore, the rotational shaft 4 comprises an outer threaded portion 41 formed at an outer circumferential surface thereof, one end thereof having an abutment portion 42 and another end thereof having a supporting portion 43. The outer threaded portion 41 and the inner threaded portion 142 are fastened to each other. The abutment portion 42 is arranged corresponding to the air bottle 3, and the supporting portion 43 is configured to engage with the screwdriver head 221 and to rotate by the screwdriver head 221.

Figure 3:
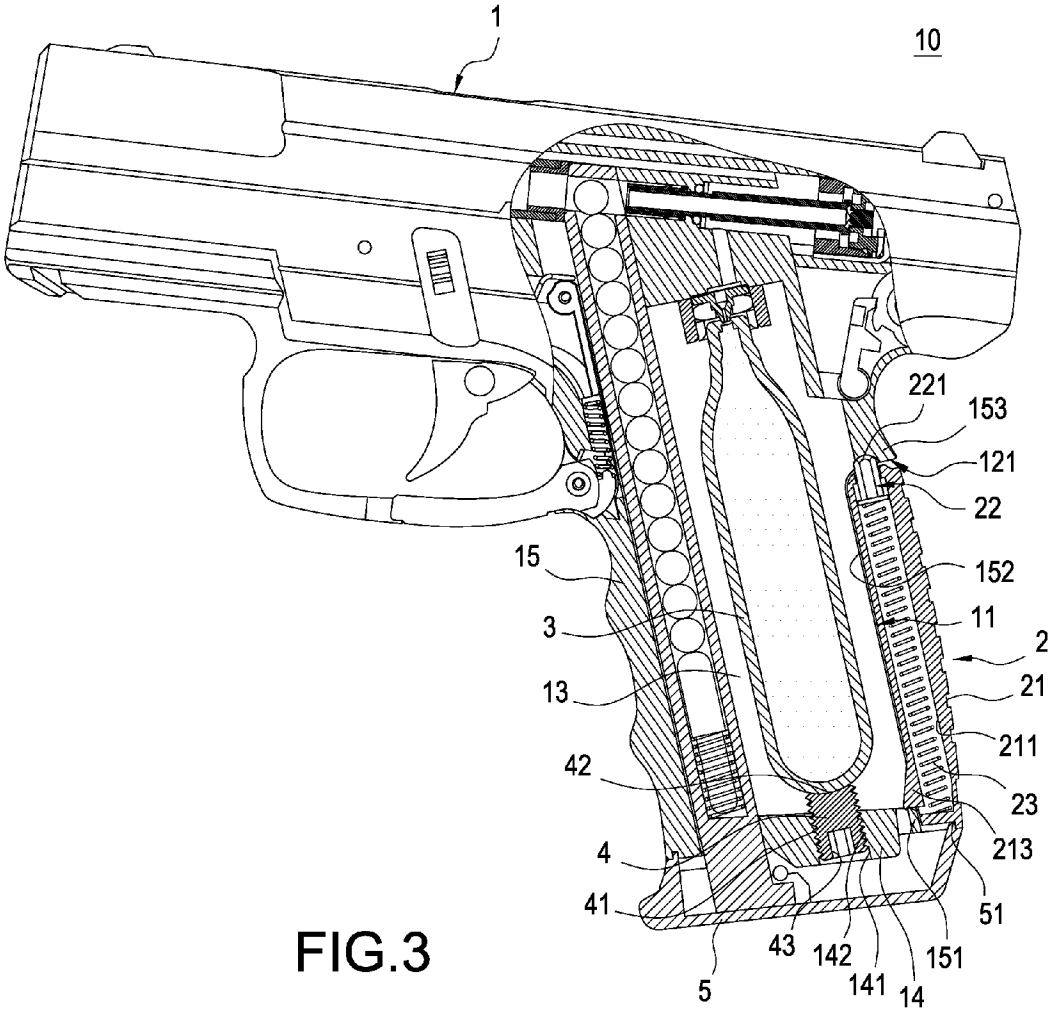
FIG. 3 is a partial cross sectional view of the toy gun of the present invention.

As shown in FIG. 1 to FIG. 3, the toy gun 10 of the present invention further comprises a bottom shield 5. The bottom shield 5 covers the bottom portion of the gun handle 15 and includes one end arranged corresponding to the L-shaped slot 152; the bottom shield 5 includes a press-fit portion 51 configured corresponding to the inner wall 12; the press-fit portion 51 is fitted onto the tool housing 21 in order to enhance the structural stability of the tool housing 21 attached to the concave slot 11.

As shown in FIG. 1 to FIG. 3, according to an assembly of the toy gun of the present invention, it utilizes the gun housing 1 having the concave slot 11 and the inner wall 12 formed inside the concave slot 11; the inner wall 12 includes the stopping portion 121; the hand-tool assembly 2 is detachably attached onto the concave slot 11; the hand-tool assembly 2 comprises the tool housing 21 and the hand-tool 22; the hand-tool 22 is received in the tool housing 21 and having one end exposed out of the tool housing 21; the tool housing 21 is configured to fitted onto the concave slot 11 correspondingly; the hand-tool 22 is blocked and positioned by the stopping portion 121. Therefore, with such structure, the toy gun 10 includes the hand-tool 22 built therein in order to facilitate the detachment, assembly or piercing of the air bottle 3 by the user such that the convenience of use of the toy gun 10 can be increased.

Figure 4:
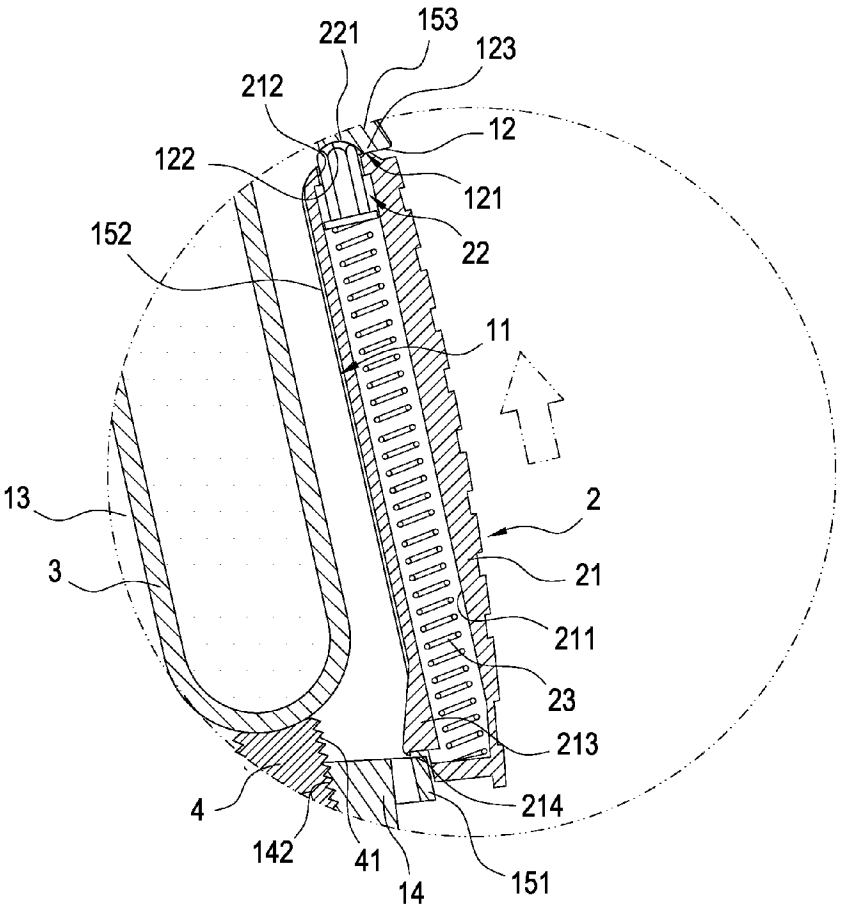
FIG. 4 is an illustration showing a state of use of the toy gun of the present invention.
Figure 5:
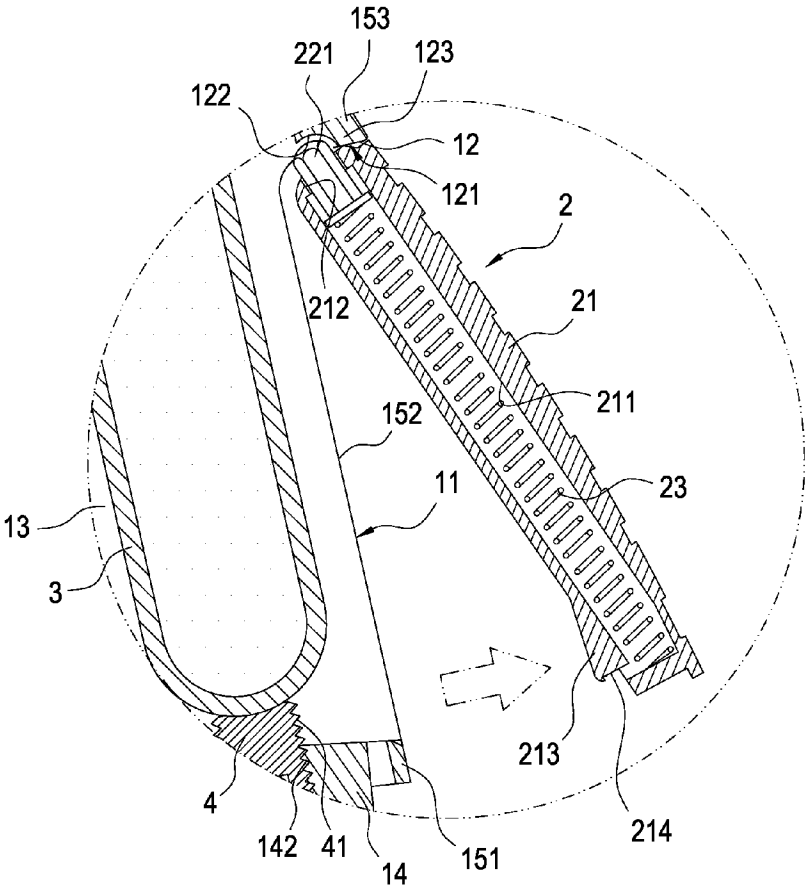
FIG. 5 is an illustration showing another state of use of the toy gun of the present invention.
Figure 6:
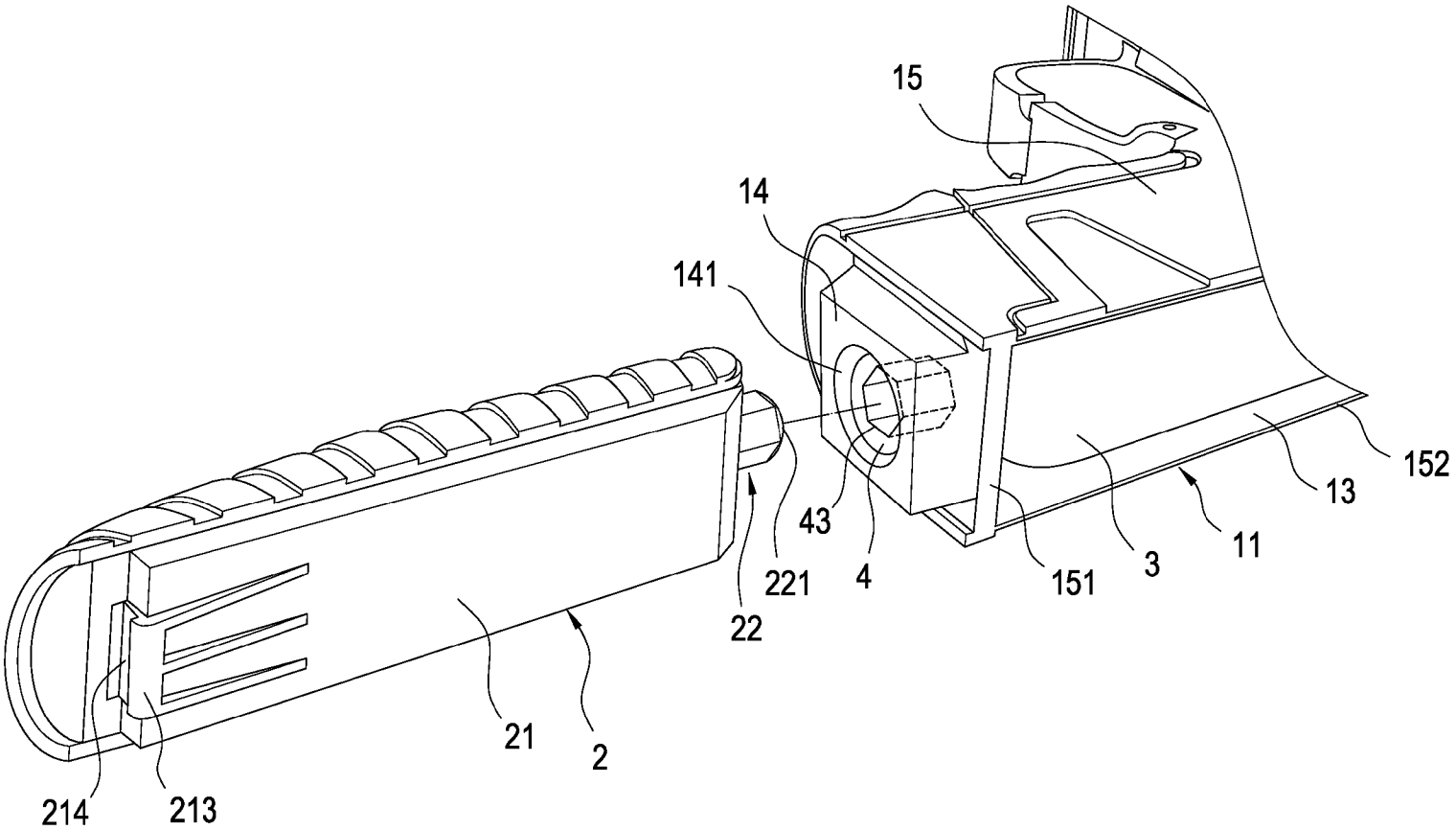
FIG. 6 is an illustration showing still another state of use of the toy gun of the present invention.

FIG. 4 to FIG. 6 shows states of the uses of the toy gun 10 of the present invention. The present invention utilizes the elastic member 23 clamped between the hand tool 22 and the tool housing 21; therefore, the hand-tool assembly 2 is pushed toward the stopping portion 121, and the hand-tool 22 is pushed by the inner wall of the groove 122 to retract inward into the tool housing 21 such that the protrusion 151 can be disengaged from the locking member 213 to allow the bottom portion of the tool housing 21 to disengage from the concave slot 11 as well; finally, the hand-tool 22 is able to disengage from the stopping member 123 in order to allow the hand-tool assembly 2 to be retrieved from the concave slot 11. Next, the screwdriver head 221 can be used to engage the supporting portion 43, and the rotation of the screwdriver head 221 would also drive the supporting portion 43 to rotate together in order to allow the rotational shaft 4 to move relative to the opening slot 141 and to push against the air bottle 3 such that the air bottle 3 is pushed toward the air valve to pierce the air bottle. 3 Once the air bottle 3 is pierced, it is able to provide the driving force necessary for the shooting of the toy gun 10; therefore, the convenience of use of the toy gun 10 can be increased.

In addition, the screwdriver head 221 can also be used for fastening or releasing the fastening members (not shown in the figures) on the toy gun 10 in order to facilitate the assembly and disassembly of the toy gun 10; therefore, the convenience of use of the toy gun 10 can be increased.

Furthermore, the hand-tool assembly 2 can be assembled onto or detached from the concave slot 11 in order to store the hand-tool 22 inside the toy gun 10 as a built-in unit such that the accidental loss of the hand-tool 22 can be prevented and readily access to the hand-tool 22 during the needs for the hand-tool 22 as an auxiliary means of the toy gun 10 can be achieved as well as allowing the hand-tool 22 to be retrieved from the toy gun 10 with ease.

Moreover, the gun housing 1 includes the concave slot 11 and the inner wall 12 formed inside the concave slot 11; the inner wall 12 includes the stopping portion 121; the hand-tool assembly 2 comprises the tool housing 21, the hand-tool 22 and the elastic member 23; the hand-tool 22 is received in the tool housing 21 and having one end exposed out of the tool housing 21; the elastic member 23 is clamped between the hand-tool 22 and the tool housing 21; the tool housing 21 is configured to attached onto the concave slot 11 correspondingly; the hand-tool 22 can be blocked and positioned by the stopping portion 121. Therefore, the present invention is able to achieve the assembly and detachment of the hand-tool assembly 2 built in the gun housing 1 with a simple configuration and cooperation of the components of the toy gun 10 such that the toy gun 10 of the present invention is of the merits of simplified assembly and low cost.

In addition, as shown in FIG. 2 and FIG. 7 to FIG. 8, the hand-tool 2 can be a screwdriver tool of such as a flathead screwdriver, a Philips screwdriver and a hexagon screwdriver. Also, the supporting portion 43 is configured corresponding to the shape of the screwdriver head 221 to include a flathead-shaped slot, a Philips-shaped slot or a hexagon-shaped slot in order to allow the supporting portion 43 to engage with the screwdriver head 221 and to rotate together with the screwdriver head 221.

In view of the above, the present invention of a toy gun with a built-in hand-tool assembly can indeed achieve the objectives as expected while overcoming the drawbacks of the known art, which is certainly of novelty and inventive step as well as complying with the requirement of patentability. The present invention is, therefore, legitimately applied for the grant of a patent.

What is claimed is:

1. A toy gun with a built-in hand-tool assembly, comprising:

a gun housing having a concave slot and an inner wall formed inside the concave slot; the inner wall having a stopping portion formed thereon; and a hand-tool assembly detachably attached onto the concave slot; the hand-tool assembly comprising a tool housing and a hand-tool, the hand-tool having a first end and a second end opposite to the first end; the first end of the hand-tool being received in the tool housing and having the second end exposed out of the tool hosing; the tool hosing configured to be fitted onto the concave slot correspondingly; the hand-tool configured to be blocked and positioned by the stopping portion, wherein the hand-tool assembly further comprises an elastic member; the elastic member is disposed inside the tool housing, and the first end of the hand-tool is elastically against the elastic member, so that the hand-tool is able to move along an extension and compression direction of the elastic member to be exposed outside of the tool housing.

2. The toy gun with a built-in hand-tool assembly according to claim 1, wherein the hand-tool assembly further comprises an elastic member; the elastic member is clamped between the hand-tool and the tool housing.

3. The toy gun with a built-in hand-tool assembly according to claim 2, further comprising an air bottle and a rotational shaft; wherein the gun housing includes an air bottle slot and a bottom wall at a bottom portion thereof; the bottom wall includes an opening slot connected to the air bottle slot; the air bottle is received inside the air bottle slot; the rotational shaft is attached to the opening slot and arranged corresponding to the air bottle.

4. The toy gun with a built-in hand-tool assembly according to claim 3, wherein an inner circumferential surface of the opening slot includes an inner threaded portion in the gun housing; the hand-tool includes a screwdriver head exposed at the tool housing; the rotational shaft comprises an outer threaded portion formed at an outer circumferential surface thereof, one end of the rotational shaft having an abutment portion and another end of the rotational shaft having a supporting portion; the outer threaded portion and the inner threaded portion are fastened to each other; the abutment portion is arranged corresponding to the air bottle, and the supporting portion is configured to engage with the screwdriver head and to rotate by the screwdriver head.

5. The toy gun with a built-in hand-tool assembly according to claim 4, wherein the gun housing includes a gun handle; the concave slot is formed at the gun handle; the hand-tool assembly has a first part accommodated into the concave slot and a second part exposed outside of the concave slot, the second part directly contacts and is held by a user; the air bottle is formed at an internal of the gun handle; the bottom wall is formed at a bottom portion of the gun handle.

6. The toy gun with a built-in hand-tool assembly according to claim 5, wherein the gun handle includes a protrusion extended therefrom and arranged corresponding to the stopping portion; the tool housing includes a locking member extended at one end away from the hand-tool, and the protrusion is locked onto the locking member.

7. The toy gun with a built-in hand-tool assembly according to claim 6, wherein the locking member includes an insertion slot; the protrusion is inserted into and positioned by the insertion slot.

8. The toy gun with a built-in hand-tool assembly according to claim 4, wherein the concave slot is formed by an L-shaped slot extended on one side of the gun handle and a bottom portion thereof; the gun handle includes a bulged portion formed opposite from the L-shaped slot, and the inner wall is formed at a surface of the bulged portion arranged corresponding to the L-shaped slot.

9. The toy gun with a built-in hand-tool assembly according to claim 8, further comprising a bottom shield; wherein the bottom shield covers the bottom portion of the gun handle and having one end arranged corresponding to the L-shaped slot; the bottom shield includes a press-fit portion configured corresponding to the inner wall; the press-fit portion is fitted onto the tool housing.

10. The toy gun with a built-in hand-tool assembly according to claim 2, wherein the tool housing includes a chamber at an internal thereof and a through-hole connected to the chamber; the hand-tool and the elastic member are received inside the chamber; the elastic member pushes against the hand-tool in order to allow the hand-tool to be exposed at the through-hole.

11. The toy gun with a built-in hand-tool assembly according to claim 10, wherein the elastic member is a spiral spring.

12. The toy gun with a built-in hand-tool assembly according to claim 2, wherein the inner wall includes a groove and a stopping member formed at a surrounding of the groove; the stopping portion is formed by the stopping member.

13. The toy gun with a built-in hand-tool assembly according to claim 2, wherein the hand-tool is a flathead driver, a Philips screwdriver or a hexagon screwdriver.

* * * * *